US011187485B2

(12) United States Patent
Albright

(10) Patent No.: US 11,187,485 B2
(45) Date of Patent: Nov. 30, 2021

(54) MODULAR FIREARM MUZZLE ATTACHMENT SYSTEM

(71) Applicant: Cyrus Albright, Hartford, SD (US)

(72) Inventor: Cyrus Albright, Hartford, SD (US)

( * ) Notice: Subject to any disclaimer, the term of this patent is extended or adjusted under 35 U.S.C. 154(b) by 0 days.

(21) Appl. No.: 16/719,190

(22) Filed: Dec. 18, 2019

(65) Prior Publication Data

US 2020/0217607 A1 Jul. 9, 2020

Related U.S. Application Data

(60) Provisional application No. 62/789,771, filed on Jan. 8, 2019.

(51) Int. Cl.

| | |
|---|---|
| ***F41A 21/32*** | (2006.01) |
| ***F41A 21/30*** | (2006.01) |
| ***F41A 21/48*** | (2006.01) |
| ***F41A 21/38*** | (2006.01) |
| ***F41A 21/36*** | (2006.01) |

(52) U.S. Cl.

CPC ..... *F41A 21/325* (2013.01); *F41A 21/30* (2013.01); *F41A 21/36* (2013.01); *F41A 21/38* (2013.01); *F41A 21/482* (2013.01)

(58) Field of Classification Search

CPC ..... F41A 21/30; F41A 21/32; F41A 21/325; F41A 21/34; F41A 21/36; F41A 21/38

USPC ..... 181/223; 89/14.3; 42/79

See application file for complete search history.

(56) References Cited

U.S. PATENT DOCUMENTS

| | | | | |
|---|---|---|---|---|
| 5,036,747 | A * | 8/1991 | McClain, III | F41A 21/36 89/14.3 |
| 5,164,535 | A * | 11/1992 | Leasure | F41A 21/30 181/223 |
| 5,631,438 | A * | 5/1997 | Martel | F41A 21/36 42/79 |
| 6,425,310 | B1 * | 7/2002 | Champion | F41A 21/30 89/14.3 |
| 6,575,074 | B1 * | 6/2003 | Gaddini | F41A 21/30 89/14.4 |
| 7,587,969 | B2 * | 9/2009 | Silvers | F41A 21/30 181/223 |
| 7,661,349 | B1 | 2/2010 | Brittingham | |
| 8,209,895 | B2 | 7/2012 | Dueck | |
| 8,333,139 | B2 | 12/2012 | Addis | |
| 8,505,680 | B2 | 8/2013 | Dueck | |

(Continued)

FOREIGN PATENT DOCUMENTS

JP 2008064406 3/2008

*Primary Examiner* — Derrick R Morgan

(57) ABSTRACT

A modular firearm muzzle attachment system provides for customizing muzzle attachment characteristics by assembling selectable muzzle attachment components corresponding to desired characteristics. The system includes a plurality of internal connectors engageable together in series in a selectable order to form an internal assembly having a conduit defined by channels extending through each internal connector coupled together to form the internal assembly. Each of the internal connectors is individually structured to have associated characteristics. Each of a plurality of shrouds is couplable to a selectable one of the internal connectors of the internal assembly such that the internal assembly extends through the plurality of shrouds to define a muzzle attachment configured for coupling to a firearm.

13 Claims, 10 Drawing Sheets

(56) References Cited

U.S. PATENT DOCUMENTS

| | | | | |
|---|---|---|---|---|
| 9,121,656 | B1 | 9/2015 | McKenzie | |
| 9,234,717 | B2 | 1/2016 | Jarboe | |
| 9,513,078 | B1 | 12/2016 | Fulton | |
| 9,829,264 | B1 * | 11/2017 | Berglund | F41A 21/30 |
| 9,933,224 | B2 * | 4/2018 | Dome | F41A 21/30 |
| 2011/0154711 | A1 | 6/2011 | Dickerson | |
| 2014/0059913 | A1 | 3/2014 | Diamond | |
| 2014/0353076 | A1 * | 12/2014 | Bethlenfalvy | F41A 21/30 181/223 |
| 2016/0209154 | A1 * | 7/2016 | Wilson | F41A 21/38 |
| 2017/0146312 | A1 * | 5/2017 | Groves | F41A 21/34 |
| 2018/0058789 | A1 * | 3/2018 | Dome | F41A 21/30 |
| 2019/0353447 | A1 * | 11/2019 | Palenik, II | F41A 21/38 |
| 2019/0376758 | A1 * | 12/2019 | Tiziani | F41A 21/30 |
| 2020/0173750 | A1 * | 6/2020 | Riley | F41A 21/30 |
| 2020/0173751 | A1 * | 6/2020 | Dome | F41A 21/30 |
| 2020/0240737 | A1 * | 7/2020 | Wheeler | F41A 21/38 |

* cited by examiner

MODULAR FIREARM MUZZLE ATTACHMENT SYSTEM

CROSS-REFERENCE TO RELATED APPLICATIONS

I hereby claim the benefit under 35 U.S.C. Section 119(e) of U.S. Provisional application 62/789,771 Jan. 8, 2019

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm muzzle attachment devices and more particularly pertains to a new firearm muzzle attachment device for customizing muzzle attachment characteristics by assembling selectable muzzle attachment components corresponding to desired characteristics.

(2) Description of Related Art Including Information Disclosed Under 37 CFR 1.97 and 1.98

The prior art relates to firearm muzzle attachment devices. Such devices are provided typically as single piece devices which may be customized to fit a particular set of desired characteristics. However, these known devices do not provide for adjustment or customization through modular components which can be assembled, broken down, and reassembled on site to provide desired characteristics.

BRIEF SUMMARY OF THE INVENTION

An embodiment of the disclosure meets the needs presented above by generally comprising a plurality of internal connectors engageable together in series in a selectable order to form an internal assembly having a conduit defined by channels extending through each internal connector coupled together to form the internal assembly. Each of the internal connectors is individually structured to have associated characteristics. Each of a plurality of shrouds is couplable to a selectable one of the internal connectors of the internal assembly such that the internal assembly extends through the plurality of shrouds to define a muzzle attachment configured for coupling to a firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
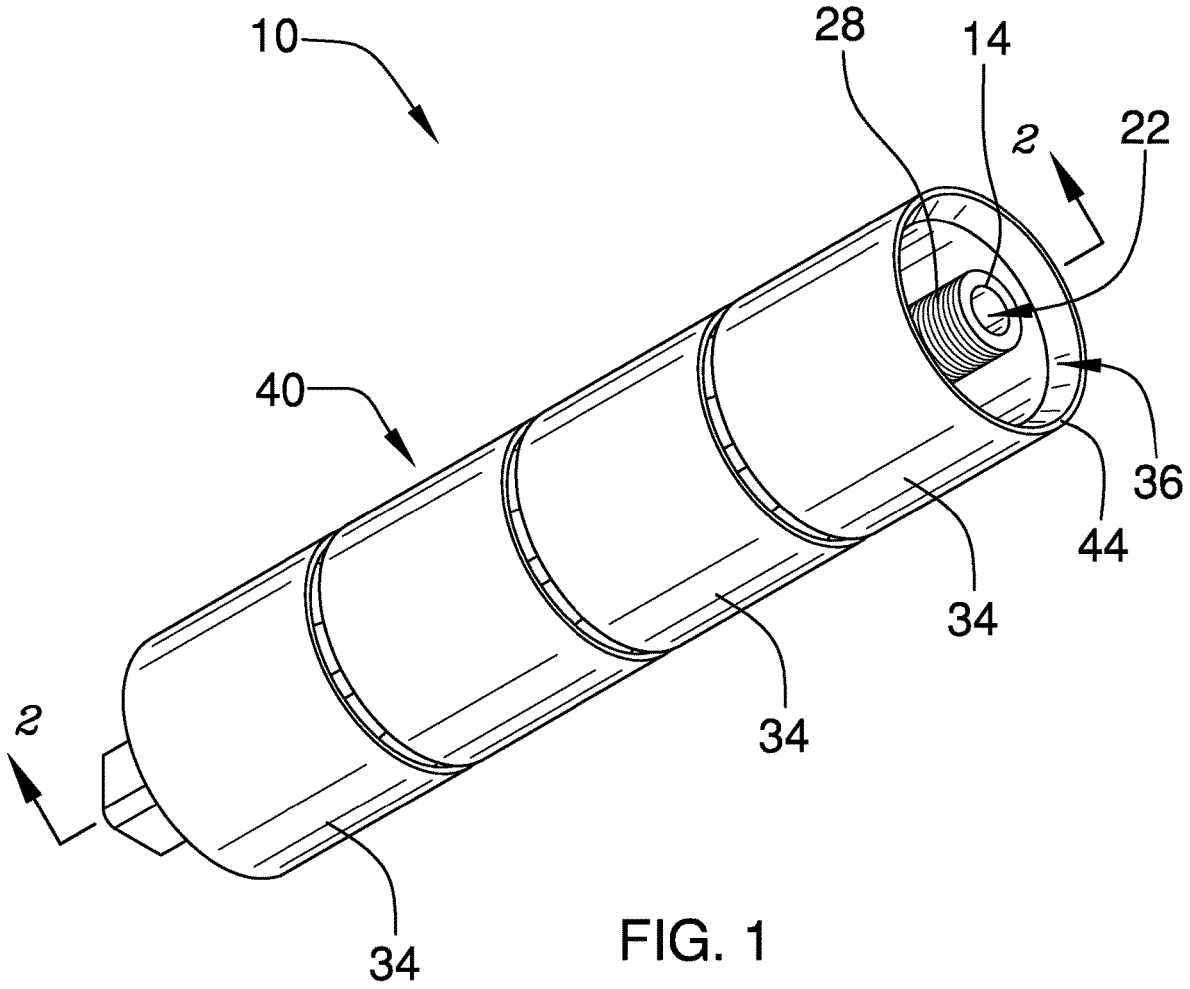
FIG. 1 is a top front side perspective view of a modular firearm muzzle attachment device according to an embodiment of the disclosure.
Figure 2:
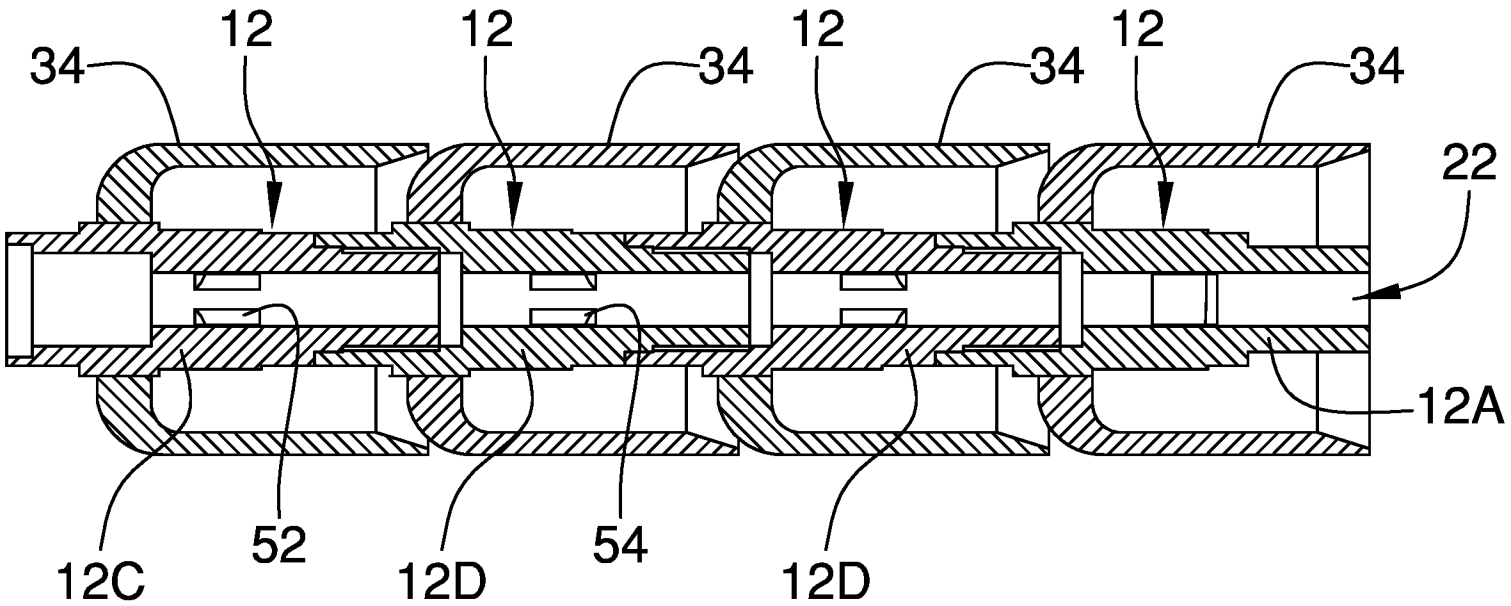
FIG. 2 is a cross-sectional view of an embodiment of the disclosure taken along line 2-2 of FIG. 1.
Figure 3:
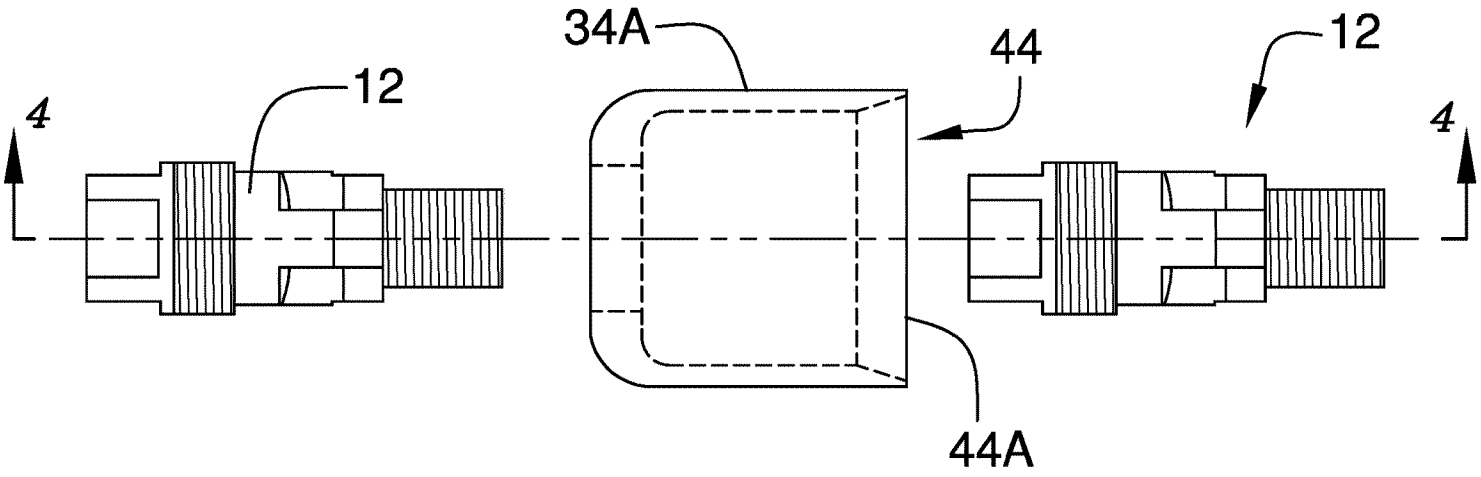
FIG. 3 is an exploded side view of an embodiment of the disclosure.
Figure 4:
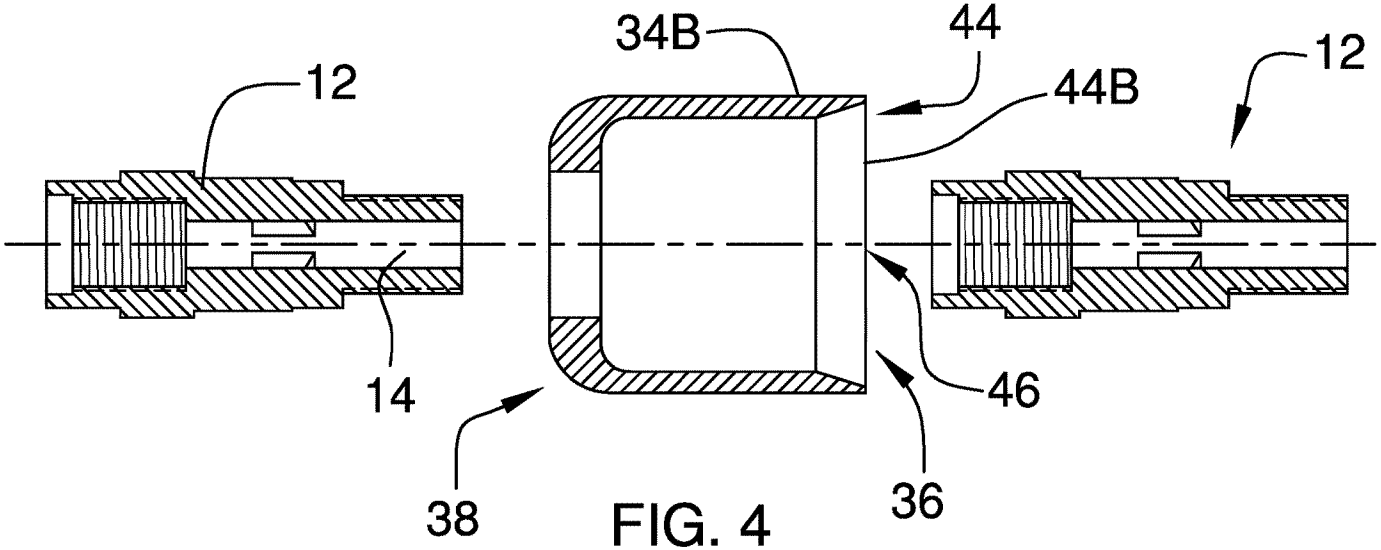
FIG. 4 is a cross-sectional view of an embodiment of the disclosure taken along line 4-4 of FIG. 3.
Figure 5:
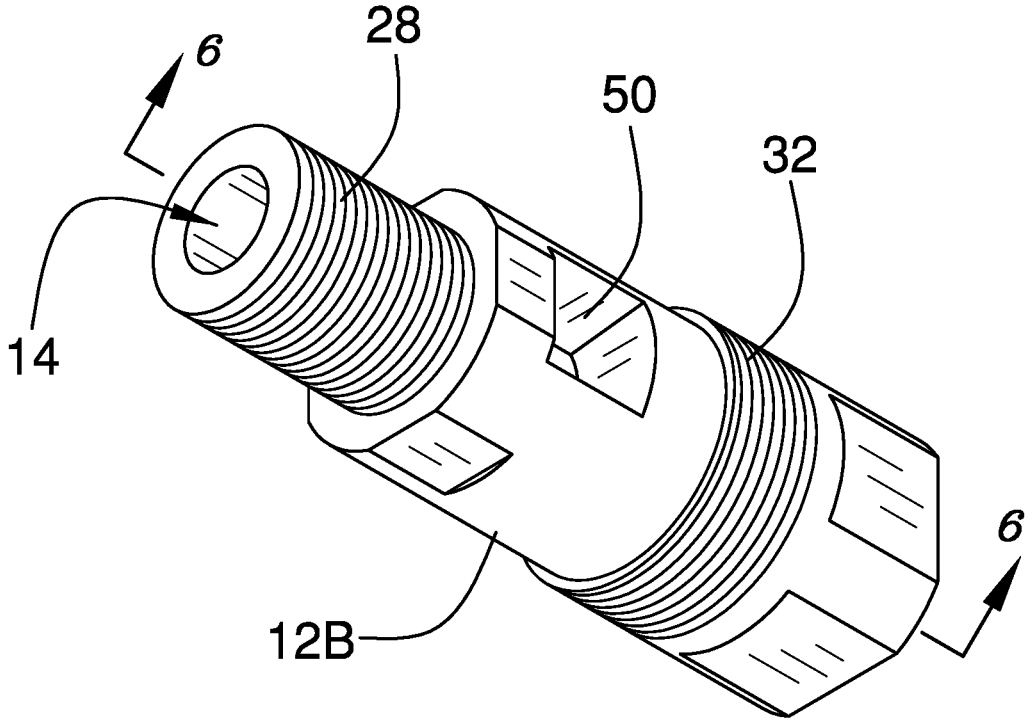
FIG. 5 is a perspective view of a modular component of an embodiment of the disclosure.
Figure 6:
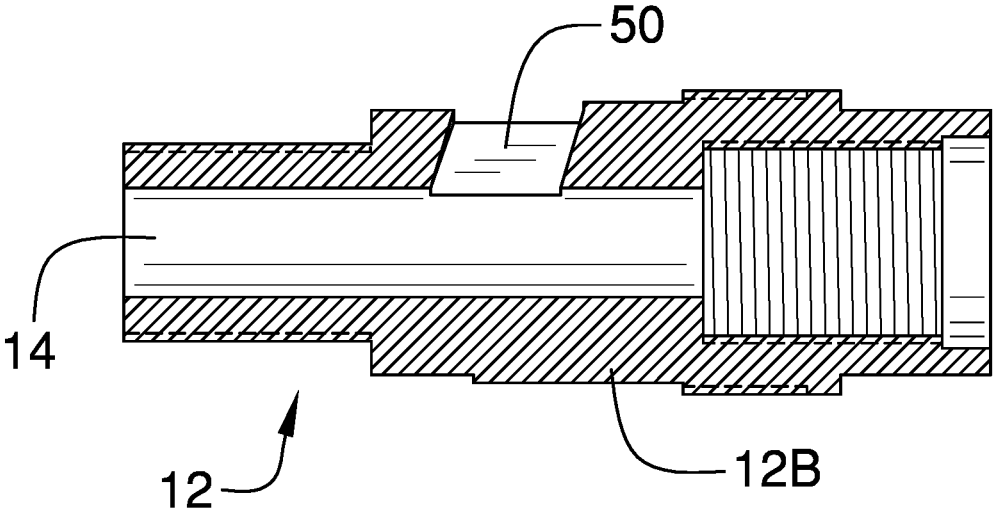
FIG. 6 is a cross-sectional view of an embodiment of the disclosure taken along line 6-6 of FIG. 5.
Figure 7:
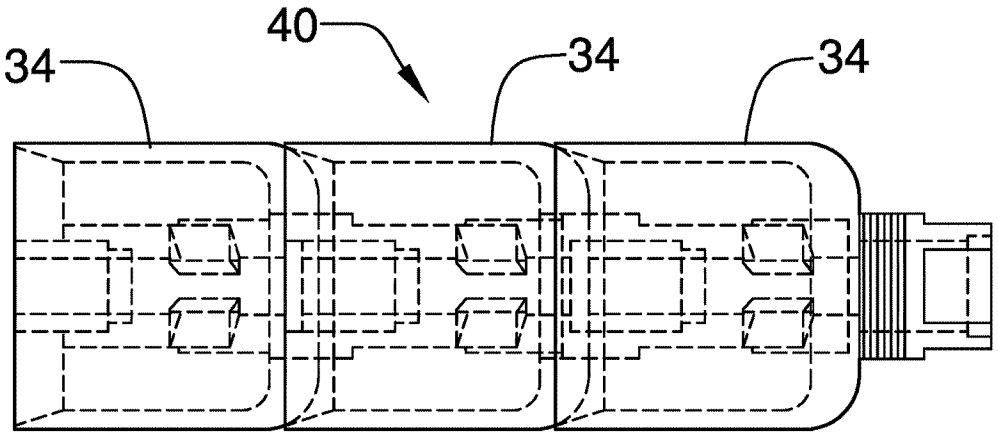
FIG. 7 is a side view of an embodiment of the disclosure.
Figure 8:
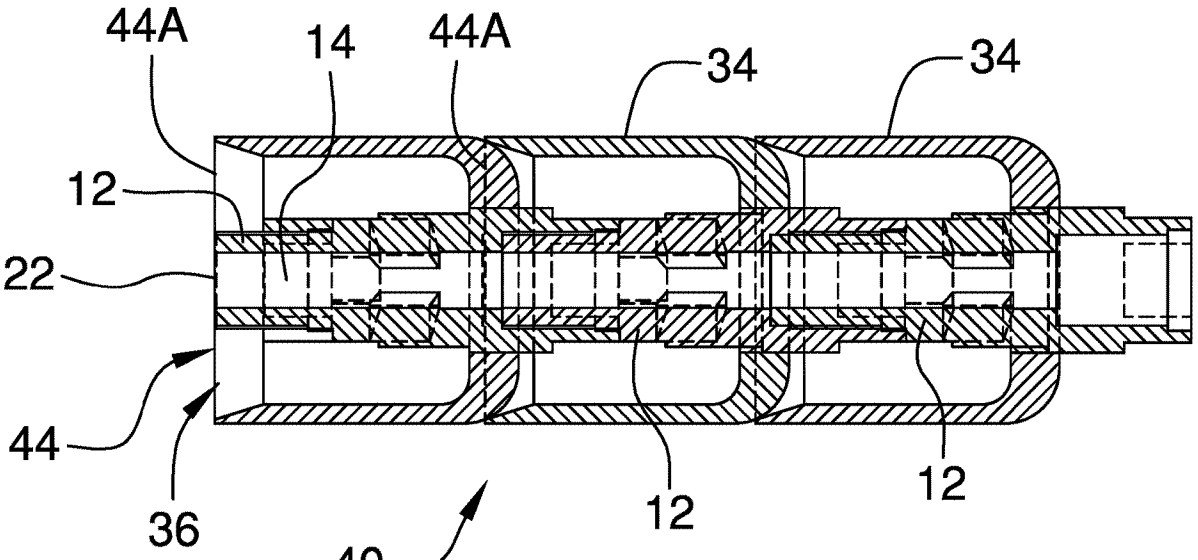
FIG. 8 is a cross-sectional view of an embodiment of the disclosure.
Figure 9:
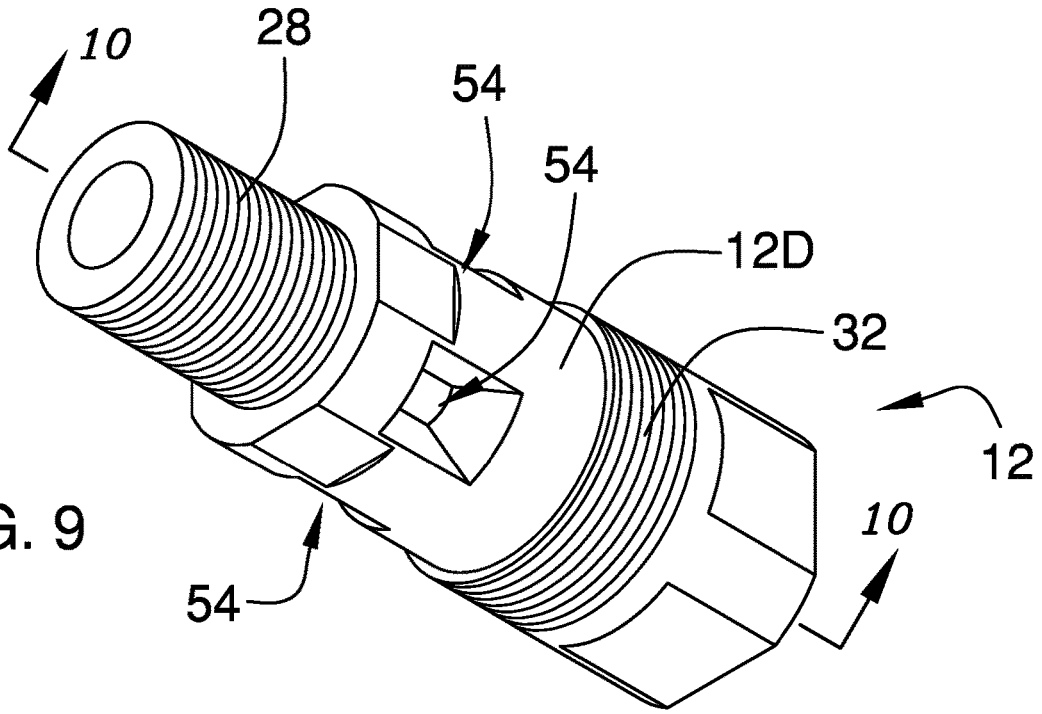
FIG. 9 is a perspective view of a modular component of an embodiment of the disclosure.
Figure 10:
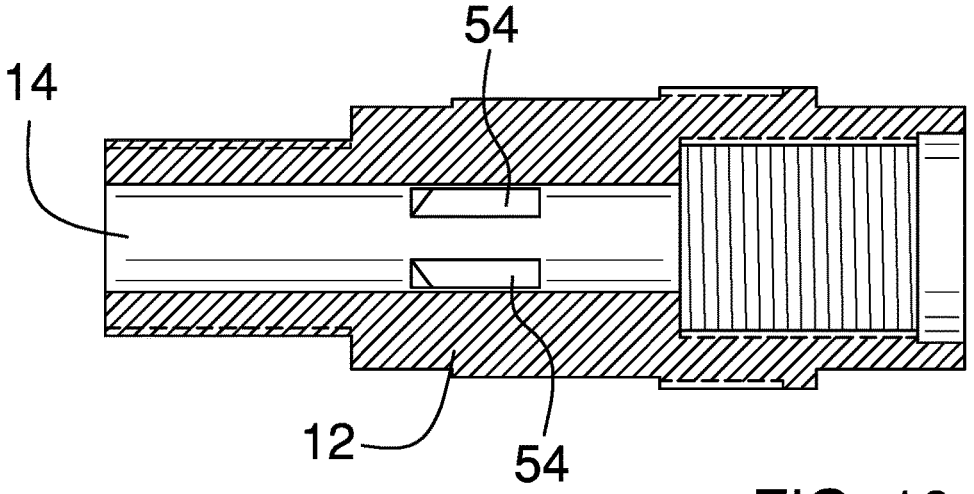
FIG. 10 is a cross-sectional view of an embodiment of the disclosure taken along line 10-10 of FIG. 9.
Figure 11:
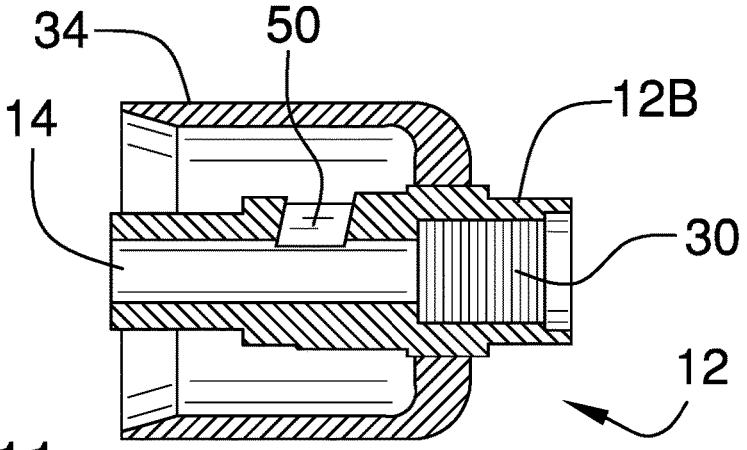
FIG. 11 is a cross-sectional view of an embodiment of the disclosure.
Figure 12:
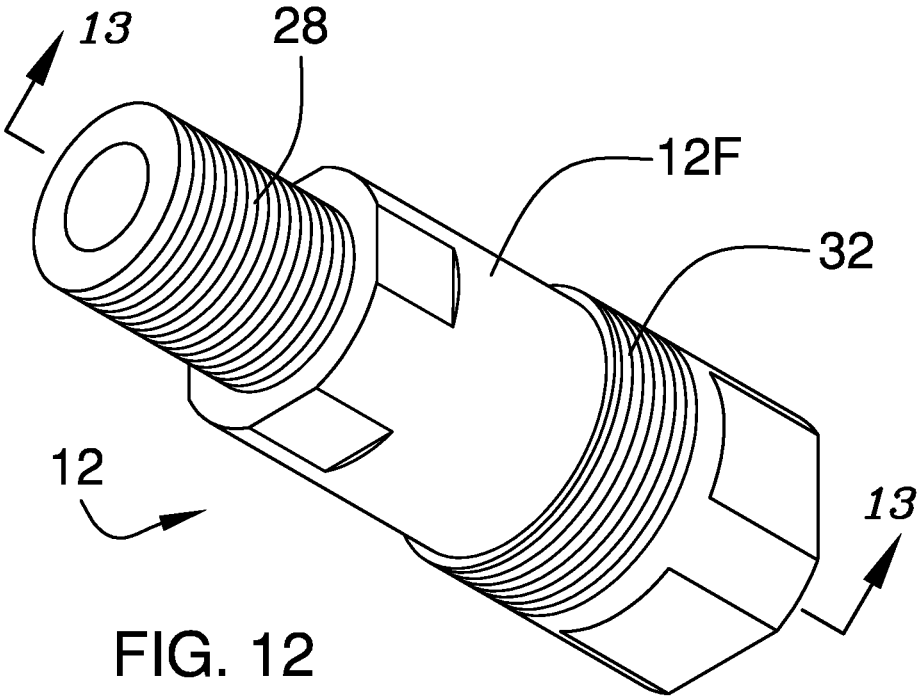
FIG. 12 is a perspective view of a modular component of an embodiment of the disclosure.
Figure 13:
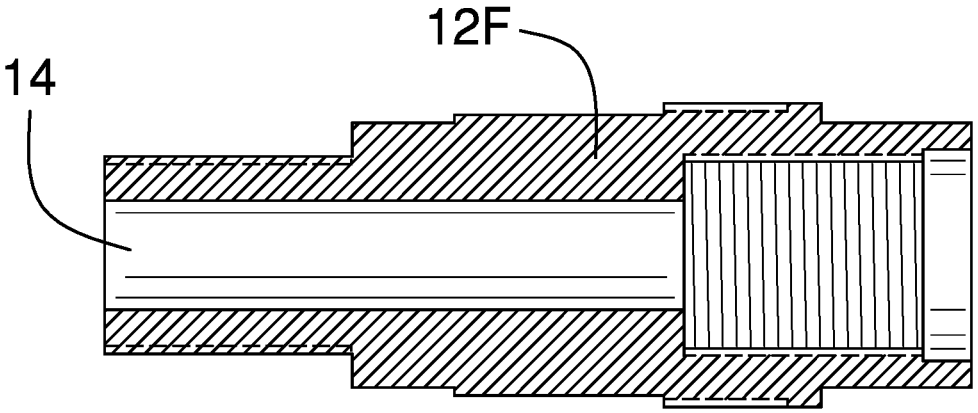
FIG. 13 is a cross-sectional view of an embodiment of the disclosure taken along line 13-13 of FIG. 12.
Figure 14:
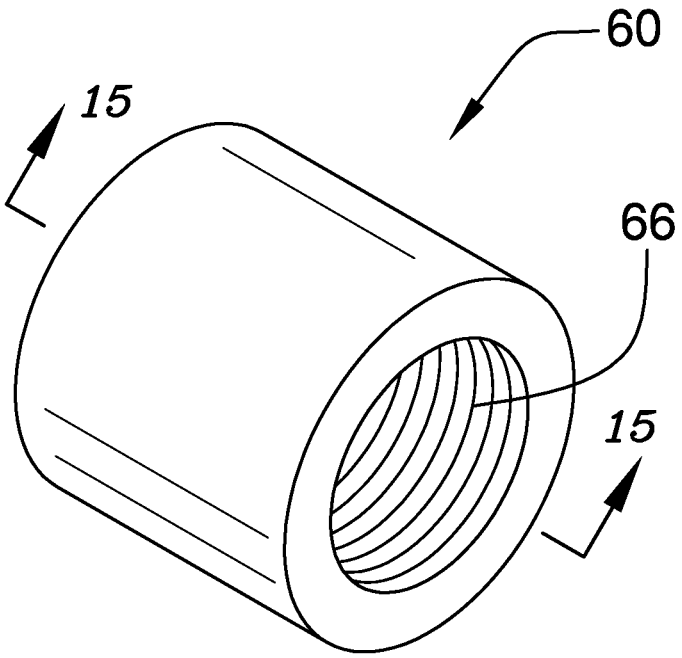
FIG. 14 is a perspective view of a modular component of an embodiment of the disclosure.
Figure 15:
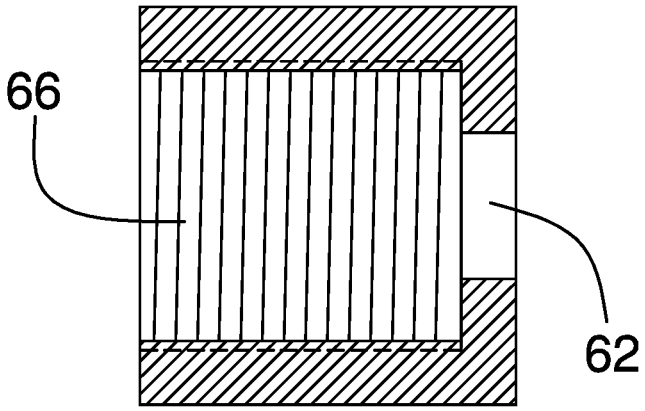
FIG. 15 is a cross-sectional view of an embodiment of the disclosure taken along line 15-15 of FIG. 14.
Figure 16:
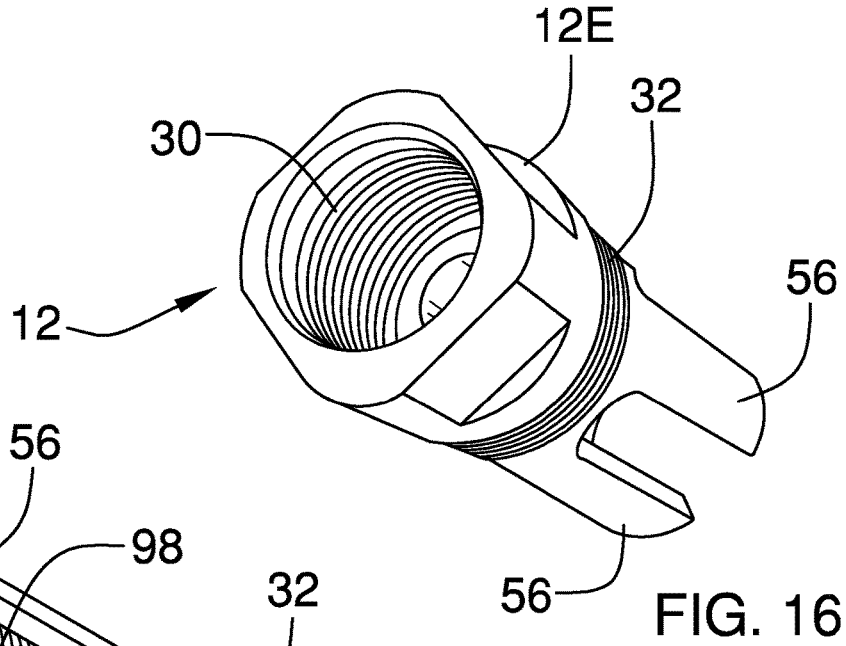
FIG. 16 is a perspective view of a modular component of an embodiment of the disclosure.
Figure 17:
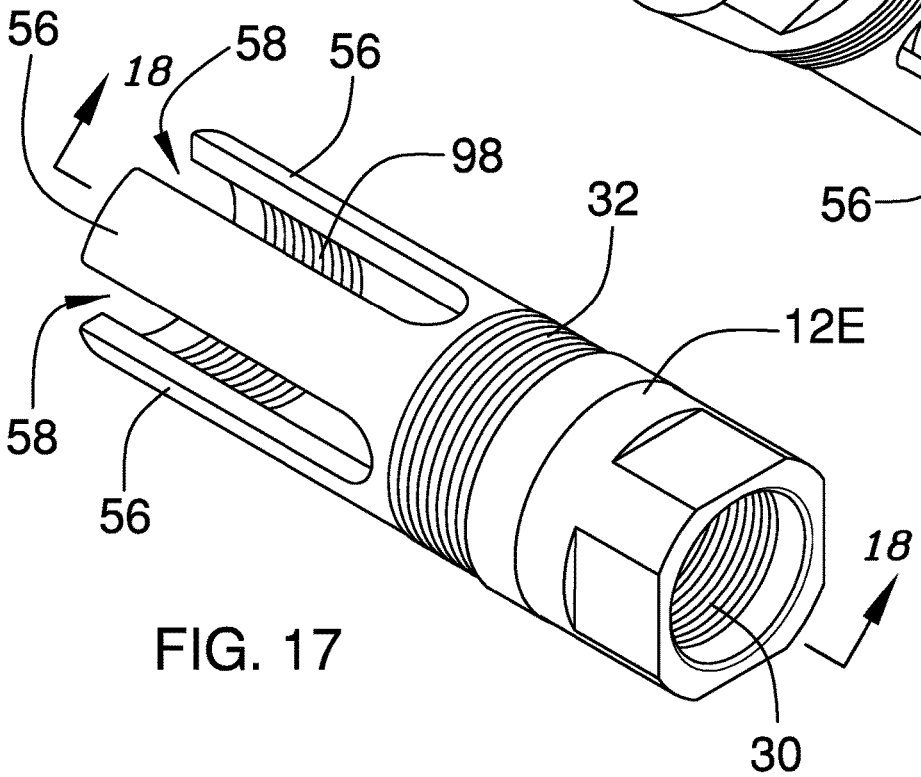
FIG. 17 is a perspective view of a modular component of an embodiment of the disclosure.
Figure 18:
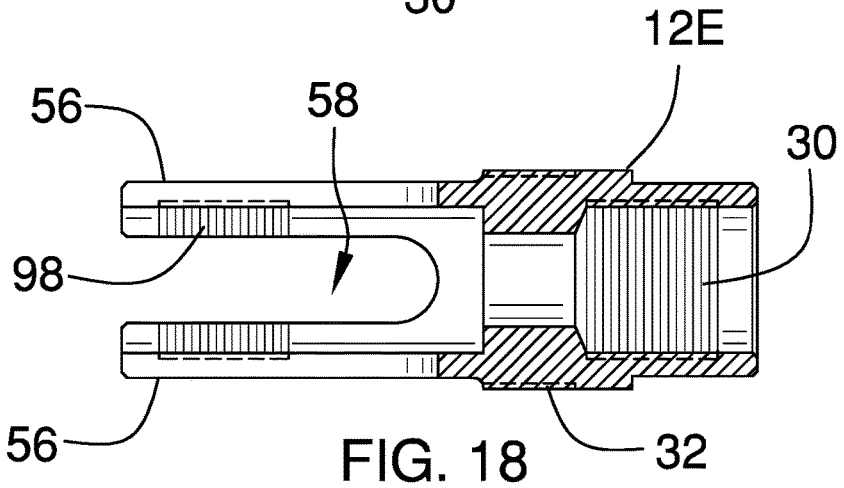
FIG. 18 is a cross-sectional view of an embodiment of the disclosure.
Figure 19:
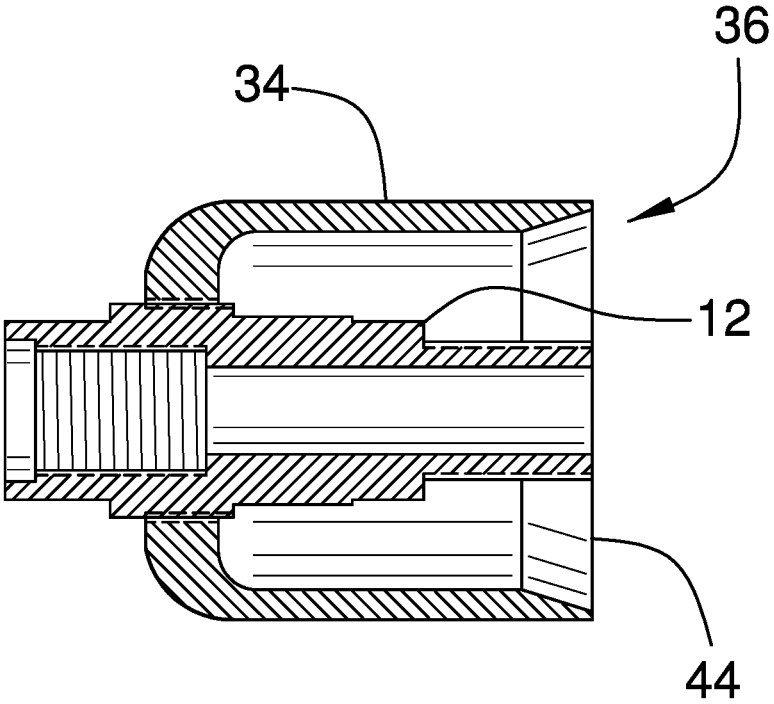
FIG. 19 is a cross-sectional view of modular components of the disclosure.
Figure 20:
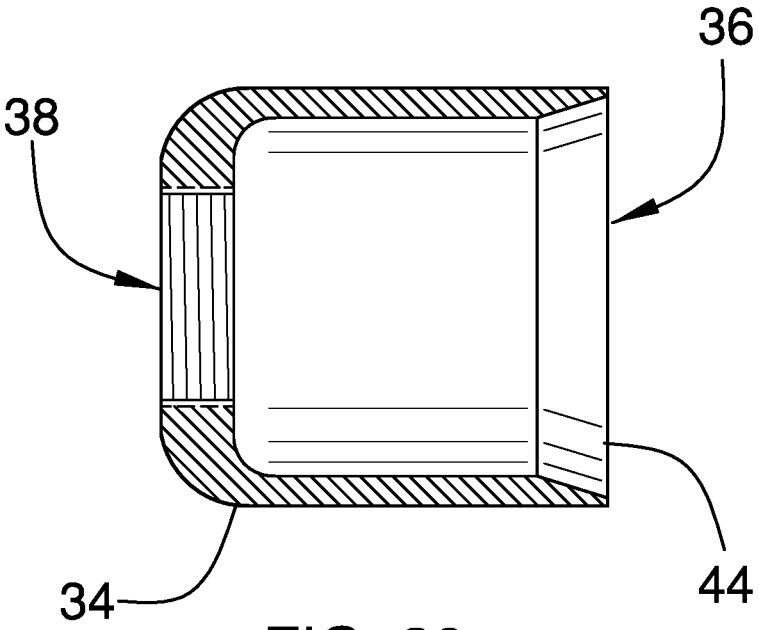
FIG. 20 is a cross-sectional view of a modular component of the disclosure.

With reference now to the drawings, and in particular as shown throughout the drawing FIGS. 1 through 20, a new firearm muzzle attachment device embodying the principles and concepts of an embodiment of the disclosure and generally designated by the reference numeral 10 will be described.

As best illustrated in the drawing FIGS. 1 through 20, the modular firearm muzzle attachment system 10 generally comprises a plurality of internal connectors 12. Each of the internal connectors 12 is cylindrical having a central channel 14 extending between a front end 16 of the internal connector 12 and a rear end 18 of the internal connector 12. The plurality of internal connectors 12 is engageable together in series in a selectable and thus, customizable, order to form an internal assembly 20 having a conduit 22 extending through the internal assembly 20. The conduit 22 is defined by the channels 14 extending through the internal connectors 12 coupled together and linearly aligned to form the internal assembly 20. Each of the internal connectors 12 is individually structured to have associated characteristics described in more detail below, wherein each internal connector 12 is configured to be coupled to a muzzle 24 of a firearm 26 such that a projectile fired from the firearm 26 and gasses produced from firing the firearm 26 pass through the internal assembly 20. Each of the internal connectors 12 has front threading 28 positioned externally adjacent to the front end 16. Each of the internal connectors 12 has rear threading 30 positioned internally adjacent to the rear end 18. Each of the internal connectors 12 also has medial external threading 32.

Each of a plurality of shrouds 34 has an open end 36 and a closed end 38. Each shroud 34 is couplable to a selectable one of the internal connectors 12 of the internal assembly 20 such that the internal assembly 20 extends through the linearly aligned plurality of shrouds 34 to define a muzzle attachment 40 configured for coupling to the firearm 26. The characteristics of the muzzle attachment 40 such as heat dispersion, flash suppression, and gas dispersion direction to dampen recoil, sway, or other movement, are customized based on the particular internal connectors 12 selected and assembled to form the muzzle attachment 40. Each shroud 34 has shroud threading 42 complementary to the medial external threading 32 of each of the internal connectors 12 wherein each shroud 34 is threadably couplable to each internal connector 12. Each of the shrouds 34 has a peripheral edge 44 extending around and defining the open end 36. The plurality of shrouds 34 includes unvented shrouds 34A and vented shrouds 34B. Each vented shroud 34B has an undulated peripheral edge 44B defining the open end 38. The peripheral edge 44B defines a plurality of spaced vents 46 when the peripheral edge 44B abuts the closed end 38 of an adjacently positioned one of the shrouds 34. Each of the unvented shrouds 34A has a planar perimeter edge 44A defining the open end 36 wherein an entirety of the planar perimeter edge 44A is evenly spaced from the closed end 38 of an adjacently positioned one of the plurality of shrouds 34 and positioned in abutment or nearly in abutment with the adjacently positioned shroud 34. The term unvented as applied to the unvented shroud 34A is not intended to suggest no venting from the shroud 34A, i.e. abutment with the adjacent shroud 34 may or may not be present, but that the shroud 34A has no specific structure to enhance or add to venting through the open end 36 as is provided with the vents 46 of the vented shroud 34B.

As noted above, each of the internal connectors 12 has common structure but will also have individual characteristics related to unique structure compared to other internal connectors 12. This is not intended to limit the invention to provision of only a single one of each unique internal connector 12. Similarly structured internal connectors 12 may be used together to multiply or enhance the particular characteristics of that specific structure. Further, the system 10 provides for customization such that only those specific internal connectors 12 having desired characteristics for the assembled muzzle attachment 40 need be used to form the muzzle attachment 40. Thus, each unique internal connector 12 need not be used in forming the muzzle attachment 40 if the characteristics of that specific internal connector 12 are not desired for the muzzle attachment 40.

The plurality of internal connectors 12 includes a sway stabilizing connector 12A. the sway stabilizing connector 12A has a pair of side apertures 48 directing the gasses laterally away from the conduit 22. The sway stabilizing connector 12A is configured to reduce lateral sway when the firearm 26 is fired.

The plurality of internal connectors 12 includes a horizontal recoil countering connector 12B. The horizontal recoil countering connector 12B has a single opening 50 directing the gasses upwardly and rearwardly towards the closed end 38 of the shroud 34. The horizontal recoil countering connector 12B is configured to reduce muzzle lift when the firearm 26 is fired.

The plurality of internal connectors 12 includes a forward gas dispersing connector 12C. The forward gas dispersing connector 12C has a plurality of openings 52 directing the gasses forwardly towards the open end 36 of the shroud 34. The forward gas dispersing connector 12C is configured to reduce inline muzzle recoil when the firearm 26 is fired.

The plurality of internal connectors 12 includes a rearward gas dispersing connector 12D having a plurality of openings 54. The openings 54 are evenly spaced radially around the rearward gas dispersing connector 12D directing the gasses rearwardly and evenly around the rearward gas dispersing connector 12D. The plurality of internal connectors 12 includes a slotted gas dispersing connector 12E having a plurality of prongs 56 defining slots 58 therebetween. The prongs 56 may be angled providing angling to the slots 58. The slots 58 are evenly spaced radially around the slotted gas dispersing connector 12E directing the gasses rearwardly and evenly around the slotted gas dispersing connector 12E. The slotted gas dispersing connector 12E is similar in purpose to the rearward gas dispersing connector 12D but provides greater open area for greater gas dispersal as may be desired for higher caliber firearms or to provide enhanced rearward gas dispersal using a single internal connector 12 as opposed to using multiple rearward gas dispersing connectors 12D. As opposed to the front threading 28, the slotted gas dispersing connector 12E provides for inward facing threading 98 on the prongs 56 to engage forward threading 28 on another internal connector 12.

The plurality of internal connectors 12 includes a non gas dispersing connector 12F having no openings between the front end 16 and the rear end 18. The non gas dispersing connector 12F may be used to effectively lengthen a barrel of the firearm 26 or alter balance of the firearm 26 without providing enhanced gas dispersal effects.

A cap 60 has cap threading 66 couplable to the front threading 28 of each of the internal connectors 12. The cap 60 covers the front threading 28. The cap 60 has an aperture 62 aligned with the conduit 22 through the internal assembly 20 when the cap 60 is coupled to the internal assembly 20 to allow the cap 60 to protect the front threading 28 during use of the firearm 26. Alternatively, the cap 60 may be provided without the aperture 62 as a protective cover for periods of non-use.

In use, the system 10 is assembled using selectable internal connectors 12 and shrouds 34 to form the muzzle attachment 40 having specific characteristics desired for the muzzle attachment 40. The internal connectors 12 can be assembled, disassembled, and reassembled in various combinations and permutations to provide fully adjustable muzzle attachment 40 characteristics.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular customizable firearm muzzle attachment system comprising:

a plurality of internal connectors, each of said internal connectors being cylindrical having a central channel extending between a front end of said internal connector and a rear end of said internal connector, said plurality of internal connectors being engageable together in series in a selectable order to form an internal assembly having a conduit extending through said internal assembly, said conduit being defined by said channels extending through said internal connectors coupled together to firm said internal assembly, each of said internal connectors being individually structured to have associated characteristics wherein each internal connector is configured to be coupled to a muzzle of a firearm such that a projectile fired from the firearm and gasses produced from firing the firearm pass through said internal assembly; and a plurality of shrouds, each shroud of said plurality of shrouds having an open end and a closed end, each shroud of said plurality of shrouds being couplable to a selectable one of said internal connectors of said internal assembly such that said internal assembly extends through said plurality of shrouds such that said plurality of shrouds define an exterior of a muzzle attachment configured for coupling to the firearm.

2. The system of claim 1, wherein one of said plurality of internal connectors is a sway stabilizing connector, said sway stabilizing connector having a pair of side apertures directing the gasses laterally away from said conduit wherein said sway stabilizing connector is configured to reduce lateral sway when the firearm is fired.

3. The system of claim 1, wherein one of said plurality of internal connectors is horizontal recoil countering connector, said horizontal recoil countering connector having a single opening directing the gasses upwardly and rearwardly towards said closed end of said shroud wherein said horizontal recoil countering connector is configured to reduce muzzle lift when the firearm is tired.

4. The system of claim 1, wherein one of said plurality of internal connectors is a forward gas dispersing connector, said forward gas dispersing connector having a plurality of openings directing the gasses forwardly towards said open end of said shroud wherein said forward gas dispersing connector is configured to reduce inline muzzle recoil when the firearm is fired.

5. The system of claim 1, wherein one of said plurality of internal connectors is a rearward gas dispersing connector having a plurality of openings, said openings being evenly spaced radially around said rearward gas dispersing connector directing the gasses rearwardly and evenly around said rearward gas dispersing connector.

6. The system of claim 1, wherein one of said plurality of internal connectors is a slotted gas dispersing connector having a plurality of prongs defining slots therebetween, said slots being evenly spaced radially around said slotted gas dispersing connector directing the gasses rearwardly and evenly around said slotted gas dispersing connector.

7. The system of claim 1, wherein one of said plurality of internal connectors is a non gas dispersing connector having a no openings between said front end and said rear end.

8. A modular customizable firearm muzzle attachment system comprising:

a plurality of internal connectors, each of said internal connectors being cylindrical having a central channel extending between a front end of said internal connector and a rear end of said internal connector, said plurality of internal connectors being engageable together in series in a selectable order to form an internal assembly having a conduit extending through said internal assembly, said conduit being defined by said channels extending through said internal connectors coupled together to form said internal assembly, each of said internal connectors being individually structured to have associated characteristics wherein each internal connector is configured to be coupled to a muzzle of a firearm such that a projectile fired from the firearm and gasses produced from firing the firearm pass through said internal assembly;

a plurality of shrouds, each shroud of said plurality of shrouds having an open end and a closed end, each shroud of said plurality of shrouds being couplable to a selectable one of said internal connectors of said internal assembly such that said internal assembly extends through said plurality of shrouds to define a muzzle attachment configured for coupling to the firearm; and wherein said plurality of shrouds includes unvented shrouds and vented shrouds, each vented shroud having an undulated peripheral edge defining said open end wherein said peripheral edge defines a plurality of spaced vents when said peripheral edge abuts said closed end of an adjacently positioned one of said shrouds, each of said unvented shrouds having a planar perimeter edge defining said open end wherein an entirety of said planar perimeter edge abuts said closed end of an adjacently positioned one of said plurality of shrouds.

9. The system of claim 1, wherein:

each of said internal connectors has front threading positioned eternally adjacent to said front end; and each of said internal connectors has rear threading positioned internally adjacent to said rear end.

10. The system of claim 1, further comprising a cap, said cap being couplable to said front threading of each of said internal connectors wherein said cap covers said front threading.

11. The system of claim 10, wherein said cap has an aperture aligned with said conduit through said internal assembly when said cap is coupled to said internal assembly.

12. The system of claim 1, wherein:

each of said internal connectors has medial external threading; and each shroud of said plurality of shrouds has shroud threading complementary to said medial external threading of each of said internal connectors wherein each said shroud is threadably couplable to each said internal connector.

13. A modular customizable firearm muzzle attachment system comprising:

a plurality of internal connectors, each of said internal connectors being cylindrical having a central channel extending between a front end of said internal connector and a rear end of said internal connector, said plurality of internal connectors being engageable together in series in a selectable order to form an internal assembly having a conduit extending through said internal assembly, said conduit being defined by said channels extending through said internal connectors coupled together to form said internal assembly, each of said internal connectors being individually structured to have associated characteristics wherein each internal connector is configured to be coupled to a muzzle of a firearm such that a projectile fired from the firearm and gasses produced from firing the firearm pass through said internal assembly, each of said internal connectors having front threading positioned externally adjacent to said front end, each of said internal connectors has rear threading positioned internally adjacent to said rear end, each of said internal connectors has medial external threading;

a plurality of shrouds, each shroud of said plurality of shrouds having an open end and a closed end, each shroud of said plurality of shrouds being couplable to a selectable one of said internal connectors of said internal assembly such that said internal assembly extends through said plurality of shrouds such that said plurality of shrouds define an exterior of a muzzle attachment configured for coupling to the firearm, each shroud of said plurality of shrouds has shroud threading complementary to said medial external threading of each of said internal connectors wherein each said shroud is threadably couplable to each said internal connector;

wherein said plurality of shrouds includes unvented shrouds and vented shrouds, each vented shroud having an undulated peripheral edge defining said open end wherein said peripheral edge defines a plurality of spaced vents when said peripheral edge abuts said closed end of an adjacently positioned one of said shrouds, each of said unvented shrouds having a planar perimeter edge defining said open end wherein an entirety of said planar perimeter edge abuts said closed end of an adjacently positioned one of said plurality of shrouds;

wherein one of said plurality of internal connectors is a sway stabilizing connector, said sway stabilizing connector having a pair of side apertures directing the gasses laterally away from said conduit wherein said sway stabilizing connector is configured to reduce lateral sway when the firearm is fired;

wherein one of said plurality of internal connectors is horizontal recoil countering connector, said upward gas dispersing connector having a single opening directing the gasses upwardly and rearwardly towards said closed end of said shroud wherein said horizontal recoil countering connector is configured to reduce muzzle lift when the firearm is fired;

wherein one of said plurality of internal connectors is a forward gas dispersing connector, said forward gas dispersing connector having a plurality of openings directing the gasses forwardly towards said open end of said shroud wherein said forward gas dispersing connector is configured to reduce inline muzzle recoil when the firearm is fired;

wherein one of said plurality of internal connectors is a rearward gas dispersing connector having a plurality of openings, said openings being evenly spaced radially around said rearward gas dispersing connector directing the gasses rearwardly and evenly around said rearward gas dispersing connector;

wherein one of said plurality of internal connectors is a slotted gas dispersing connector having a plurality of prongs defining slots therebetween, said slots being evenly spaced radially around said slotted gas dispersing connector directing the gasses rearwardly and evenly around said slotted gas dispersing connector;

wherein one of said plurality of internal connectors is a non gas dispersing connector having a no openings between said front end and said rear end; and a cap, said cap being couplable to said front threading of each of said internal connectors wherein said cap covers said front threading, said cap having an aperture aligned with said conduit through said internal assembly when said cap is coupled to said internal assembly.

* * * * *